US006442898B1

(12) United States Patent
Wu

(10) Patent No.: US 6,442,898 B1
(45) Date of Patent: Sep. 3, 2002

(54) OPENING AND CLOSING CONTROL MECHANISM FOR PROJECT WINDOW

(76) Inventor: Pai-shen Wu, 36 Futien 2 Street, Southern District, Taichung (TW)

( * ) Notice: Subject to any disclaimer, the term of this patent is extended or adjusted under 35 U.S.C. 154(b) by 0 days.

(21) Appl. No.: 09/838,157

(22) Filed: Apr. 20, 2001

(51) Int. Cl.[7] ..... E05D 15/28
(52) U.S. Cl. ..... 49/246
(58) Field of Search ..... 49/246, 247, 248, 49/250, 252, 339, 345, 346

(56) References Cited

U.S. PATENT DOCUMENTS 4,833,754 A * 5/1989 Yang ..... 49/252
5,040,267 A * 8/1991 Dallmann ..... 49/252
5,491,930 A * 2/1996 La See ..... 49/252

FOREIGN PATENT DOCUMENTS

FR 2469540 * 5/1981 ..... 49/252

* cited by examiner

*Primary Examiner*—Jerry Redman
(74) *Attorney, Agent, or Firm*—Rabin & Berdo, P.C.

(57) ABSTRACT

An opening and closing control mechanism for the project window which mainly comprises a slide frame, a slide block, a retaining block, a pivoted force arm, a carrier arm, a support arm and a connecting arm in an effort to improve the carrier arm which works as a fixed pivot at the near end of sash to be able to bear the pushing load. The retaining block, combined with the slide frame, enhances the structural stability of the sash as well as the smoothness of opening and closing movement.

3 Claims, 4 Drawing Sheets

OPENING AND CLOSING CONTROL MECHANISM FOR PROJECT WINDOW

FIELD OF THE INVENTION

This invention relates to an improvement of an opening and closing control mechanism for a project window.

BACKGROUND OF THE INVENTION

The control mechanism for the project window as shown in FIGS. 1, 2, 3, and 4 which is [fabricated] based on the prior art is very popular. There are two identical controllers mounted on the top and bottom of the project window 10 and fitted in the sash 20. The project window 10, by linkage movement of the controllers within the sash 20, can be pushed outward at a certain angle.

The construction of the controller is briefly discussed below:

The slide frame 30 is in a ⊔ form, limiting the slide block 31 to move within the slot. A force arm 32 has a near end pivot 321 located at a far terminal of the slide frame 30 and a far end 322 pivot of the force arm 32 located in the center of carrier arm 33. A support arm 34 and a connecting arm 35 are superimposed at the pivot 311 located in the slide block 31. The other end of the support arm 34 is fitted on the pivot 341 located on the central part of the force arm 32, and the far end of the connecting arm 35 is fitted at the pivot 351 located on near end of the carrier arm 33. The force arm 32, the carrier arm 33 and the support arm 34 form an integral linkage that can be folded or extended along the pivots. In the extending movement, the interior of the slide frame 30 provides a stop 36 to limit the movement of slide block 31 thereat. The carrier arm 33 of such well-known controllers is separately installed at the inside of the top and bottom of the project 10 with the slide frame 30 fixed on the top and side of the sash 20 respectively of the project window 10.

The application principles of this controller are such that the near end pivot 321 of the force arm 32 is located at an outside end within the slide frame 30 which is an immoveable, fixed pivot. The slide block 31 within the slide frame 30 has a moveable pivot. The immoveable and moveable pivots within the slide frame 30 produce a linkage movement to cause the carrier arm 33 to be transversely extended or be vertically cross held within the slide frame 30.

As shown in FIGS. 1 and 3, the project window 10 and the sash 20 are in the [close] closed position. When a force is applied to the right side of and pushes the project window 10 outward, the project window 10 rotates around the pivot 322. The force applied is transferred to the near end of the carrier arm 33 and further to the connecting arm 35 via the pivot 351. The slide block 31 is pushed to move to the center of the slide frame 30. At this moment, the carrier arm 33 extends outward and outside the slide frame 30 and the project window 10 opens outward in 90 degrees. Now in the reverse direction, as shown in FIGS. 2 and 3, the project window 10 is being pulled back to close, whereas the project window 10 rotates around the pivot 322, the pulling force applied is transmitted to the near end of the carrier arm 3 and to the connecting arm 35 by dint of pivot 351; the carrier arm 33 is therefore retreated and folded on the slide fame 30 as shown in FIG. 2, and the project window moves inward to close.

The prior art of the controller presents the technical weaknesses as indicated below requiring improvement:

The overall weight of the project window 10 lies on the carrier arm 33 of the controller. However, the force arm 32, the support arm 34 and the connecting arm 35 share the weight partially. It is an undeniable fact that when the project window 10 is pushed to wide open position as shown in FIGS. 2 and 4, the slide block 31 has to withstand the maximum pulling force with the slide slot of the slide frame 30 with the shape of ⊔. After a very long time in operation, the slide frame 30 will gradually collapse the slot lip. Under such a circumstance, the controller will lose the energy to move smoothly.

Furthermore, the slide block 31 has to shoulder the weight of the project window 10 and moves within the slide frame 30. Regardless of how intimate the slide block 31 and the slide frame 30 will be, the heavy burden the slide block 31 has to bear makes it difficult to create a smooth linkage movement.

The slide block 31 is a sliding pivot. In the opening operation, the project window 10 will move to the center of the slide frame 30 which impairing the designed openness of the sash 20, On the contrary, it means the escape space of the sash 20 is narrowed.

Viewing from the aforementioned weaknesses, the inventor has spent relentless effort in observation and research and eventually came up with an improvement of opening and closing control mechanism for the project window to achieve the following objects.

The main object of the invention is to provide a opening and closing control mechanism for the project window where the carrier arm which holds the overall weight of the project window will be installed at the near end of sash and becomes a fixed pivot for easy assembly, opening and close linkage movement with better stability for the project window.

Another object of the invention is to furnish an improved opening and closing control mechanism for the project window with improved open position where the slide frame is fixed on inner side of sash to maintain the desirable open space, easy for escape in the event of an emergent case.

SUMMARY OF INVENTION

This invention relates to an improvement of an opening and closing control mechanism for the project window which mainly comprises a slide frame, a slide block, a retaining block, a pivoted force arm, a carrier arm, a support arm and a connecting arm in an effort to improve the carrier arm which works as a fixed pivot at the near end of sash to be able to bear the pushing load. The retaining block, combined with the slide frame, enhances the structural stability of the sash as well as the smoothness of opening and closing movement.

The improved features of the invention will be discussed in great detail with the aid of some embodiments which are illustrated in the drawings.

DETAILED DESCRIPTION OF THE INVENTION

Figure 1:
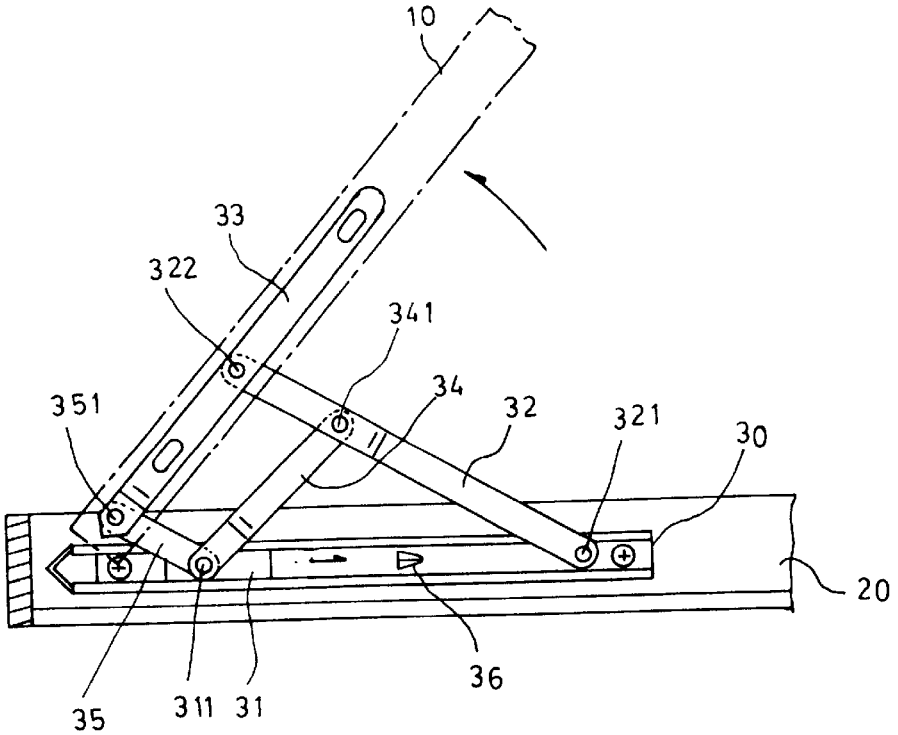
FIG 1 PRIOR ART
FIG. 1 is a schematic diagram showing the open position of the opening and closing controller for the project window fabricated by the prior art.
Figure 2:
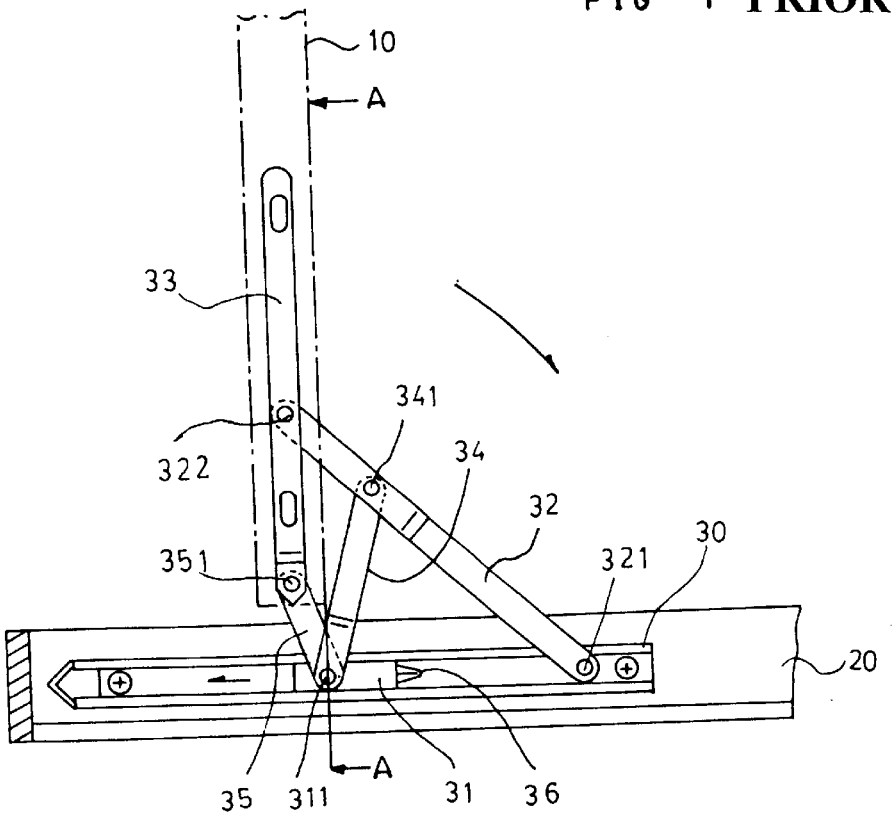
FIG 2 PRIOR ART
FIG. 2 is a schematic diagram showing the close position of the opening and closing controller for the project window fabricated by the prior art.
Figure 3:
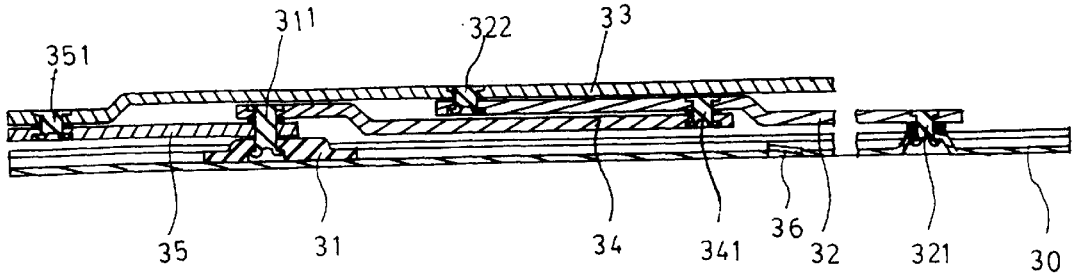
FIG 3 PRIOR ART
FIG. 3 is section illustrating folded status of the close position of the opening and closing controller for the project window fabricated by the prior art.
Figure 4:
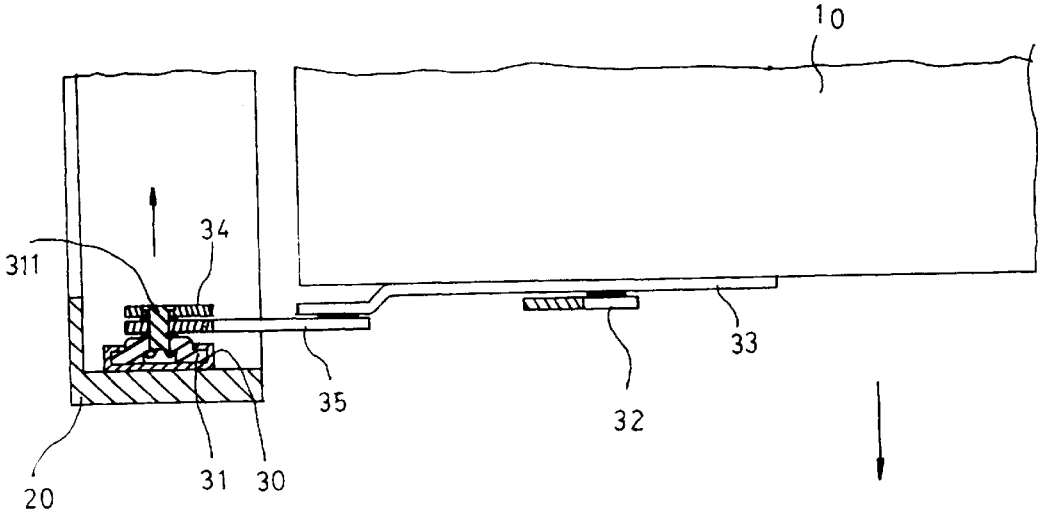
FIG 4 PRIOR ART
FIG. 4 is FIG. 2 looking from the direction A.
Figure 6:
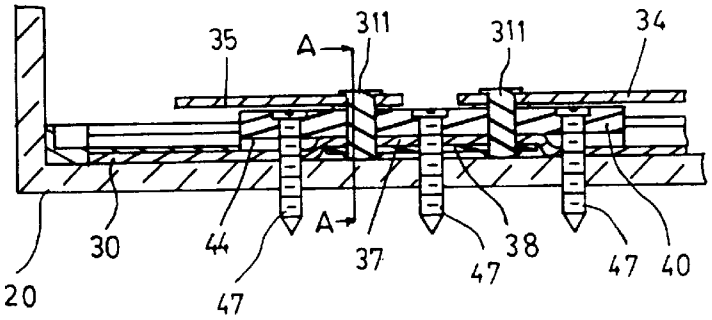
FIG. 6 a cross section of the controller installed inside of the sash.
Figure 7:
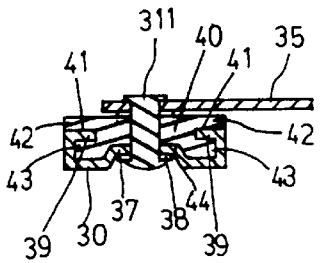
FIG. 7 is FIG. 6 looking at the direction A.
Figure 5:
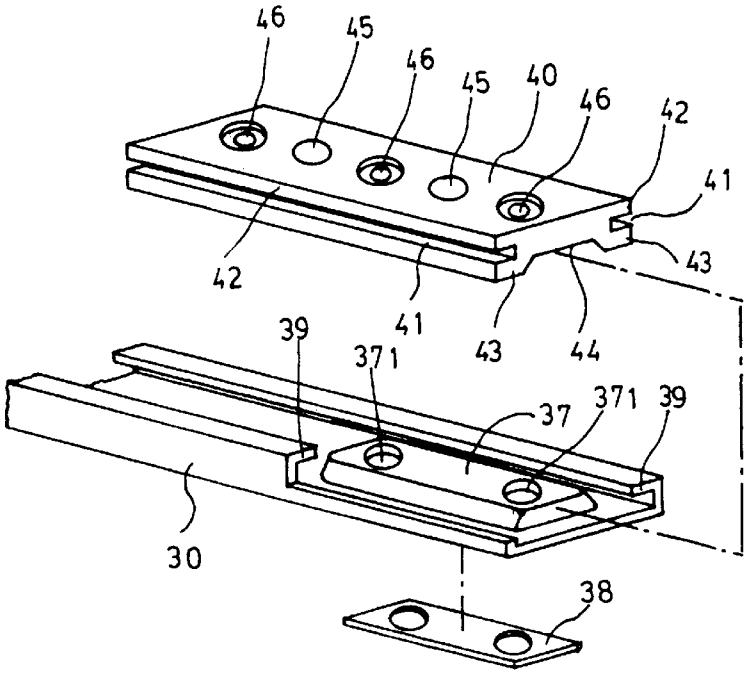
FIG. 5 is a disassembly of the retaining block and the slide frame.

An improved controller of this invention as illustrated in FIGS. 5, 6, 7, 8, and 9 is a technical evolution from the prior art, characterized in that the near end of force arm 32 is held on the slide block 31 by the pivot 321. Furthermore, the slide block 31 is located at the far end of the slide frame 30. This improvement to locate the near end of force arm 32 at the far end of the slide frame 30 forms a slide pivot point along with the slide block 31. A retaining block 40 comprises the side grooves 41 on both sides, the upper wall worked as a presser 42 and the lower wall, worked as a slide blade 43, and the groove seat 44. Two go-through pivot holes 45 and three go-through bolt holes 46 are provided on the retaining block 40. In the slide frame 30, there pops up a long strip of stop block 37. While the slide blade of the retaining block 40 slides into the slide frame 30, the lip blade 39 of the slide frame 30 lies in the side groove 41, and the presser 42 will intimately contact the lip blade 39, and the groove seat 44 will sit on the top of the pop-up stop block 37. A washer 38 is attached to the back of the stop block 37. In this arrangement, the [pivot] pivots 311 which connect the support arm 34 and the connecting arm 35 will be fastened on the retaining block 40 by dint of rivets to hook the stop block 37 and the washer 38 integrally and retain the retaining block 40 in the slide frame 30. Such an improvement limits the support arm 34 and the connecting arm 35 inside the slide frame 30 and enables the retaining block 40 to work as a non-slide fixed pivot.

In operation, the invention applies the similar technique of the prior art, where the carrier arm 33 is fastened at the inner side of the top and bottom of project window 10 respectively, the slide frame 30 fixed at the inner sides of upper and lower part of the sash 20 respectively. The screw 47 is employed to lock the slide frame 30 on the sash 20. The screw 47 further pierces through the screw hole 46 on the retaining block 40 to hold the sash 20 within the project window 10.

Figure 8:
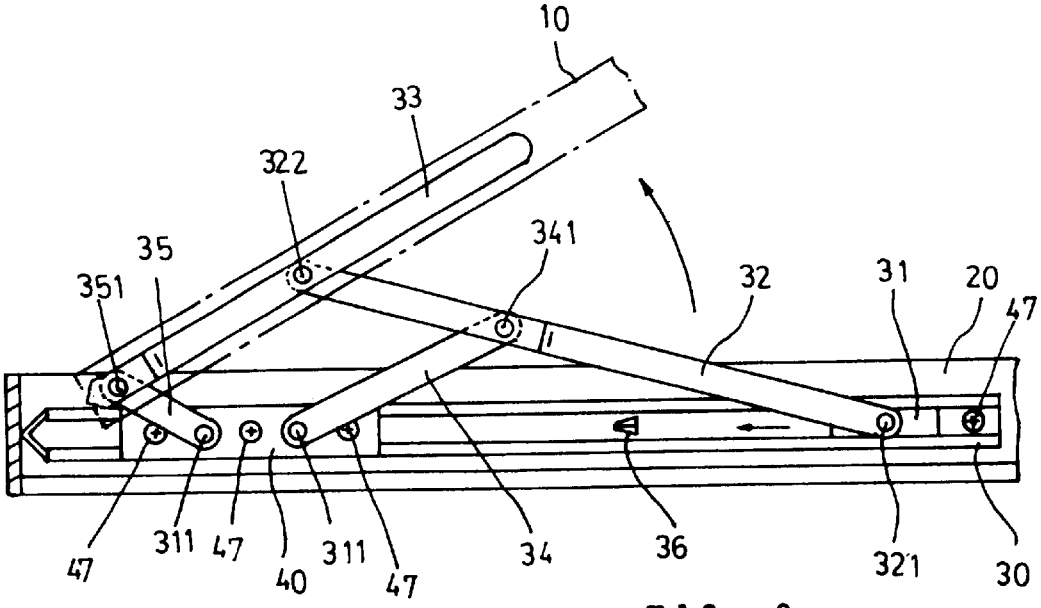
FIG. 8 is a schematic diagram showing the open position of the opening and closing controller for the project window according to the invention.
Figure 9:
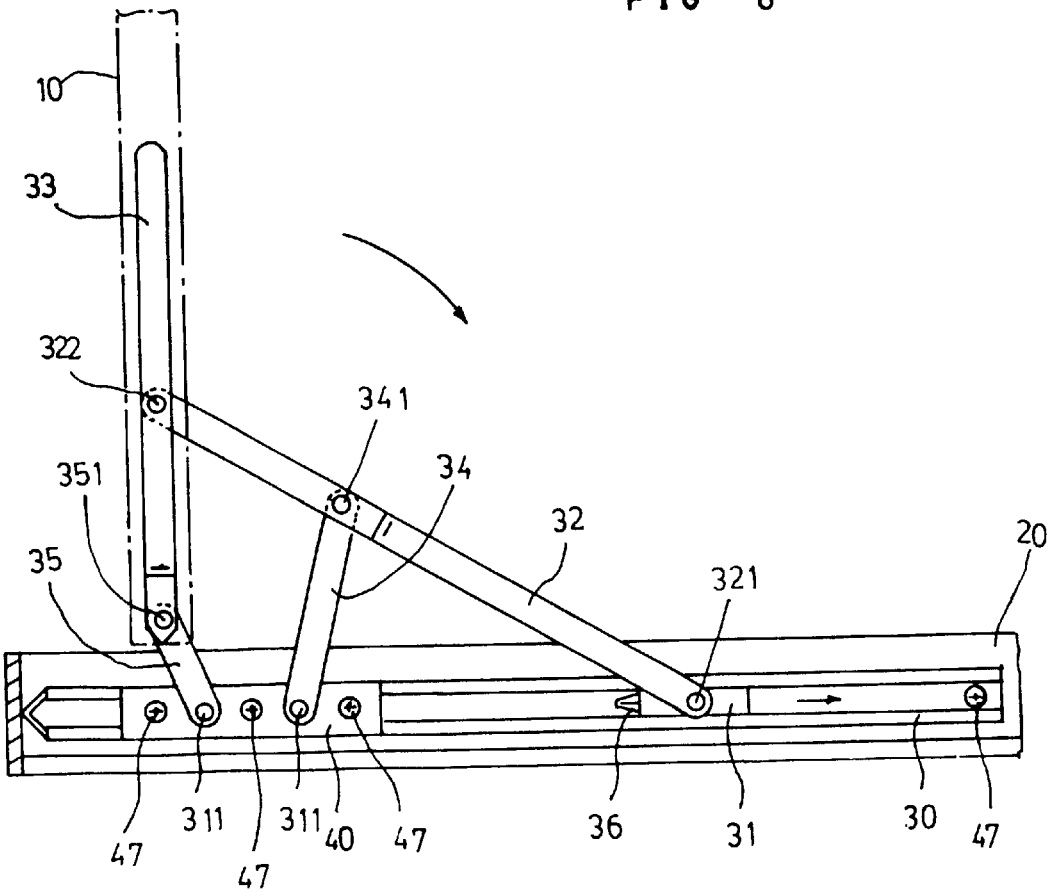
FIG. 9 is a schematic diagram showing the close position of the opening and closing controller for the project window according to the invention.

Please refer to FIG. 8. It shows the project window 10 and the sash 20 are in the closed position. When being pushed outward, the project window 10 rotates around the pivot point of the retaining block 40, the near end of the force arm 32 draws the slide block 31 and moves to the center of the slide frame 30, and the carrier arm 33 extends outside the slide frame 30 until the project window 10 turns 90 degrees as shown in FIG. 9. Contrarily, when the project window 10 is pulled back from the opened position as shown in FIG. 9 to the closed position, the retaining block 40 still acts as the fixed pivot point. The force arm 32 and the slide block 31 move outward in the slide frame 30, the carrier arm 33 will fold on the top of slide frame 30 and the project window 10 is closed as shown in FIG. 8.

From the foregoing statement, it is understood that the invention provides an improvement in the linkage principle of prior art, and attain the efficiency as described below:

The overall weight of he project window the carrier arm has to carry has now been shifted to the fixed pivot point of the retaining block. This improvement technically offers easy load movement of the project window and eliminates instability and heavy push and pull.

Since the overall weight of the project window the carrier arm has to carry is now shifted to the fixed pivot of the retaining block and the fixed pivot point is locked on the sash. This arrangement facilitates the project window to be pushed to the maximum open position and the linkage of the controller is able to work smoothly on long term.

The retaining block is located inside the slide frame. Such an arrangement furnishes a stable combination, leaves no gap for up and down jump and better robust structure.

The open position is situated on the side of the sash, which provides better width for the escape passage.

All in all, the improvement of the controller discussed in this invention is practicable and advanced product where the weaknesses of the prior art are therefore eliminated completely.

I claim:

1. An improved controller for opening and closing a project window, comprising:

a slide frame mountable to an inner side of a sash, and having two lip blades;

a stop block disposed within the slide frame;

a slide block slidably disposed within the slide frame;

a retaining block fixedly disposed within the slide frame, and having two grooves, each groove being disposed on a respective side of the retaining block, each groove being defined by an upper wall that serves as a presser and a lower wall that serves as a slide blade, each groove receiving a respective one of the lip blades therein, so that the upper wall presses on a top of the respective lip blade, the retaining block further having a groove seat formed between the two grooves, the groove seat being disposed over the stop block and receiving the stop block therein;

a washer disposed behind the stop block;

a carrier arm mountable to the project window;

a force arm having one end pivotally connected to the carrier arm, and another end pivotally connected to the slide block;

a support arm having one end pivotally connected to an intermediate portion of the force arm, and another end pivotally connected to the retaining block;

a connecting arm having one end pivotally connected to the carrier arm, and another end pivotally connected to the retaining block;

a first fastener for pivotally connecting the another end of the support arm to the retaining block, which passes through the stop block and the washer; and a second fastener for pivotally connecting the another end of the connecting arm to the retaining block, which passes through the stop block and the washer, the first and second fasteners further fixing the retaining block to the slide frame, wherein the retaining block carries a weight of the project window.

2. The controller recited in claim 1, wherein the slide frame is fastenable onto the inner side of the sash using a screw which projects through a screw hole on the retaining block to ensure a rigid assembly permitting no up and down movement while pushing and pulling the project window to open or closed positions.

3. The controller recited in claim 1, wherein a near end of the force arm is located on the slide block and the slide block is housed in a far end of the slide frame to form a slide pivot.

* * * * *